US006336730B1

(12) United States Patent
Hong

(10) Patent No.: US 6,336,730 B1
(45) Date of Patent: Jan. 8, 2002

(54) LUMINOUS NECKTIE

(76) Inventor: Kyung-Soo Hong, 1244-3, Jisan 2-dong, Soosung-ku, Taegu (KR)

( * ) Notice: Subject to any disclaimer, the term of this patent is extended or adjusted under 35 U.S.C. 154(b) by 0 days.

(21) Appl. No.: 09/383,028

(22) Filed: Aug. 25, 1999

(51) Int. Cl.[7] ..... F21V 21/08
(52) U.S. Cl. ..... 362/108; 362/103; 362/800
(58) Field of Search ..... 362/103, 108, 362/800

(56) References Cited

U.S. PATENT DOCUMENTS 4,009,799 A * 3/1977 Fathaur ..... 221/3
4,164,008 A * 8/1979 Miller ..... 362/103
4,308,572 A * 12/1981 Davidson ..... 362/103
4,570,206 A * 2/1986 Deutsch ..... 362/103
5,097,569 A * 3/1992 Erickson ..... 24/66.6
5,113,325 A * 5/1992 Eisenbraun ..... 362/103
5,836,670 A * 11/1998 Gilson ..... 362/103
5,905,262 A * 5/1999 Spanswick ..... 250/368
5,927,842 A * 7/1999 Preisler ..... 362/103

* cited by examiner

*Primary Examiner*—Alan Cariaso
*Assistant Examiner*—Hargobind S. Sawhney
(74) *Attorney, Agent, or Firm*—Skjerven Morrill MacPherson LLP

(57) ABSTRACT

This invention relates to a luminous necktie wherein a large number of light-emitting-diodes are installed to be exposed to the front part of the necktie, whereby they are in harmony with designs formed in the necktie surface to give a sense of beauty to who sees the necktie, simultaneously with raising night discrimination. The present invention comprises a large number of light-emitting-diodes(LED1, LED2, ~, LEDn) exposed to the front part of a necktie 30; a oscillation circuit portion 40 for flashing said light-emitting-diodes (LED1, LED2, ~LEDn); and a switch(SW) giving trigger signals to the trigger signal end(T) of said oscillation circuit portion 40.

11 Claims, 7 Drawing Sheets

LUMINOUS NECKTIE

BACKGROUND OF THE INVENTION

1. Field of the Invention

This invention relates to a luminous necktie, particularly to a luminous necktie wherein a large number of flashing light-emitting-diodes (LED) are installed in order to be exposed to a front part of the necktie, whereby the LEDs are positioned in harmony with designs formed in the front part of the necktie to give a sense of beauty to those who see the necktie and to increase discrimination of the designs at night.

2. Description of the Prior Art

In general, neckties are made to be worn hanging down the front of a shirt with a significant remainder of the length of the necktie visible after rounding and knotting of the necktie around the collar of the shirt.

Also, in the front parts of these neckties, various designs are printed to give a sense of beauty to those who see the neckties. However, at night, there is a problem in that the designs are difficult to see because discrimination of the designs decreases due to low light intensity.

That is, in the cases where somebody desires to attract peoples attention to the distinctive appearance of a necktie, such as religious ceremonies or events, there is a problem that, when the lighting is weak, the designs printed on a necktie cannot be seen in detail because discrimination of the designs decrease in the weak lighting.

SUMMARY OF THE INVENTION

This invention is established to solve the problems stated above. The object of the invention are to provide a luminous necktie which attracts peoples attention by increasing discrimination of the necktie at night and gives a sense of beauty to those who see it.

To accomplish the above objects, this invention provides a luminous necktie comprising a plurality of light-emitting-diodes installed in order to be exposed to the front part of the necktie; an oscillation circuit portion for flashing said light-emitting-diodes; and a switch giving trigger signals to the trigger signal input end of said oscillation circuit portion.

BRIEF DESCRIPTIONS OF THE DRAWINGS

DESCRIPTION OF THE PREFERRED EMBODIMENT

Figure 1:
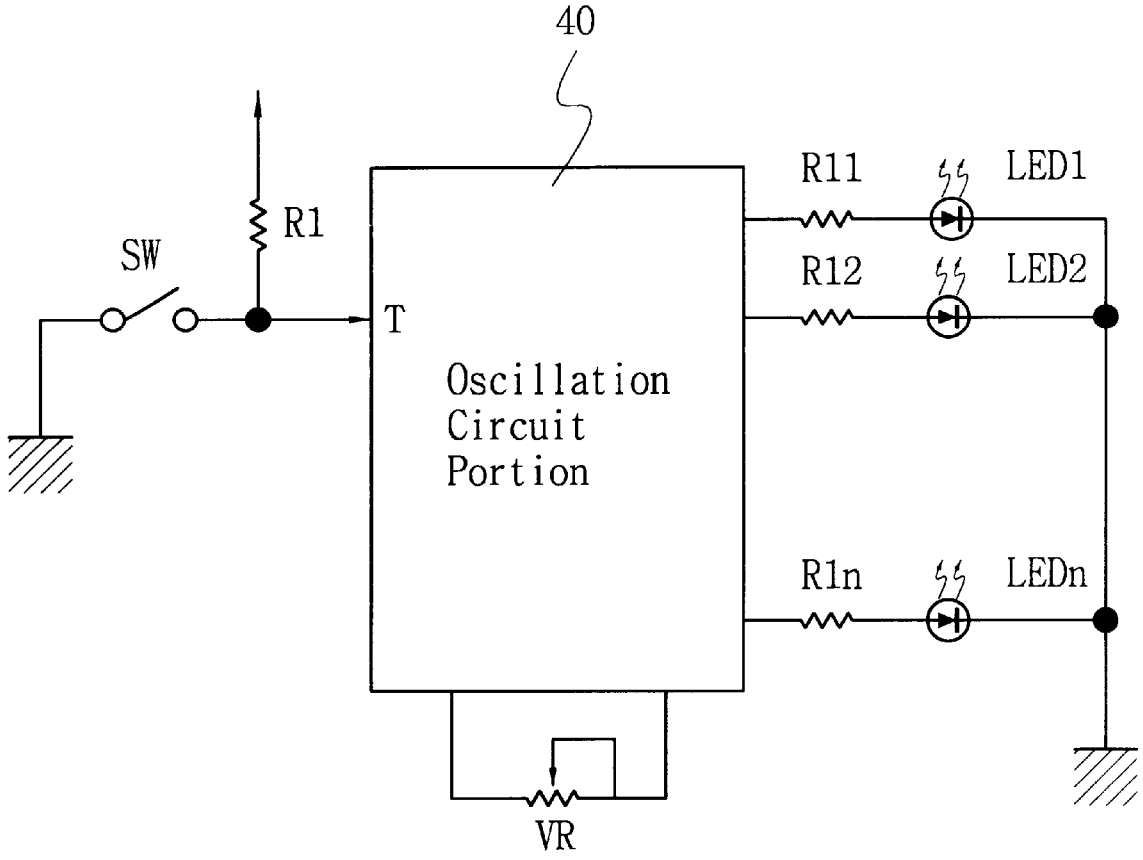
FIG. 1 is a circuit view showing the construction of the luminous necktie according to the present invention.
Figure 2:
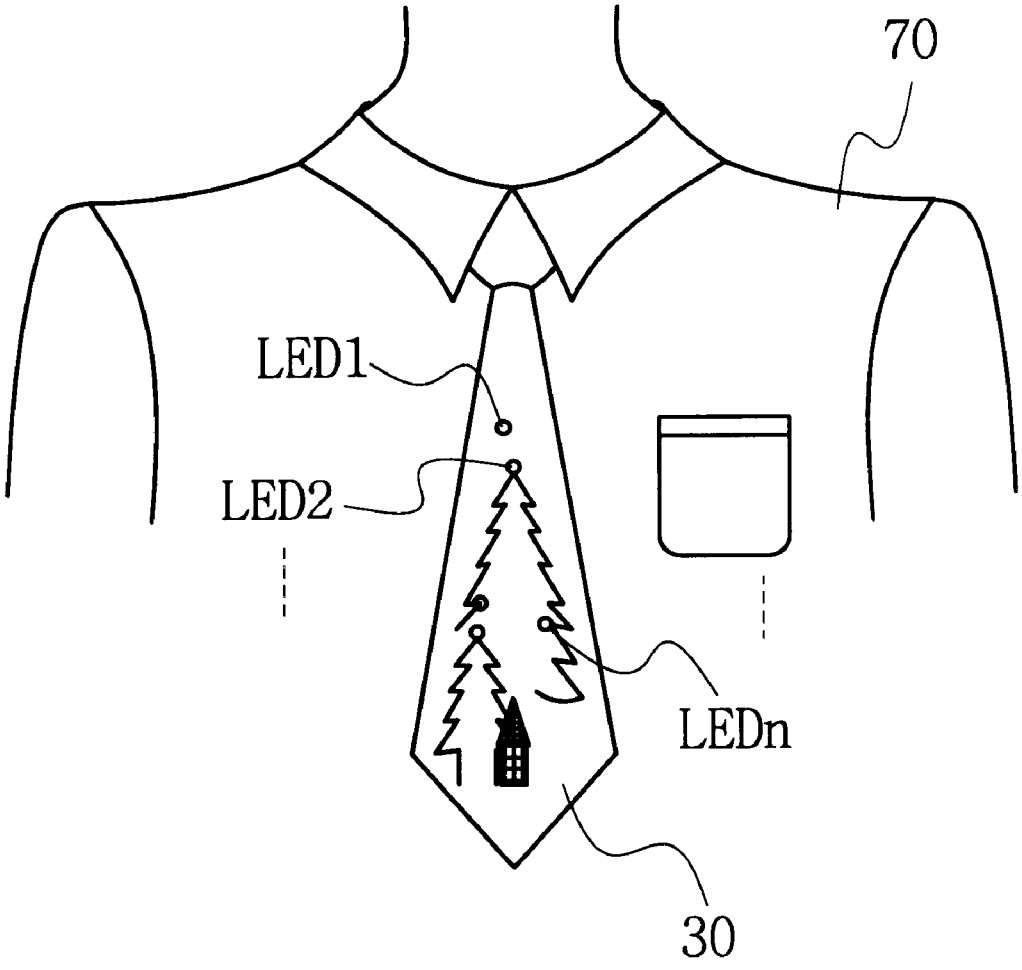
FIG. 2 is a front view showing the state of the luminous necktie, according to the present invention, worn in a shirt.
Figure 3:
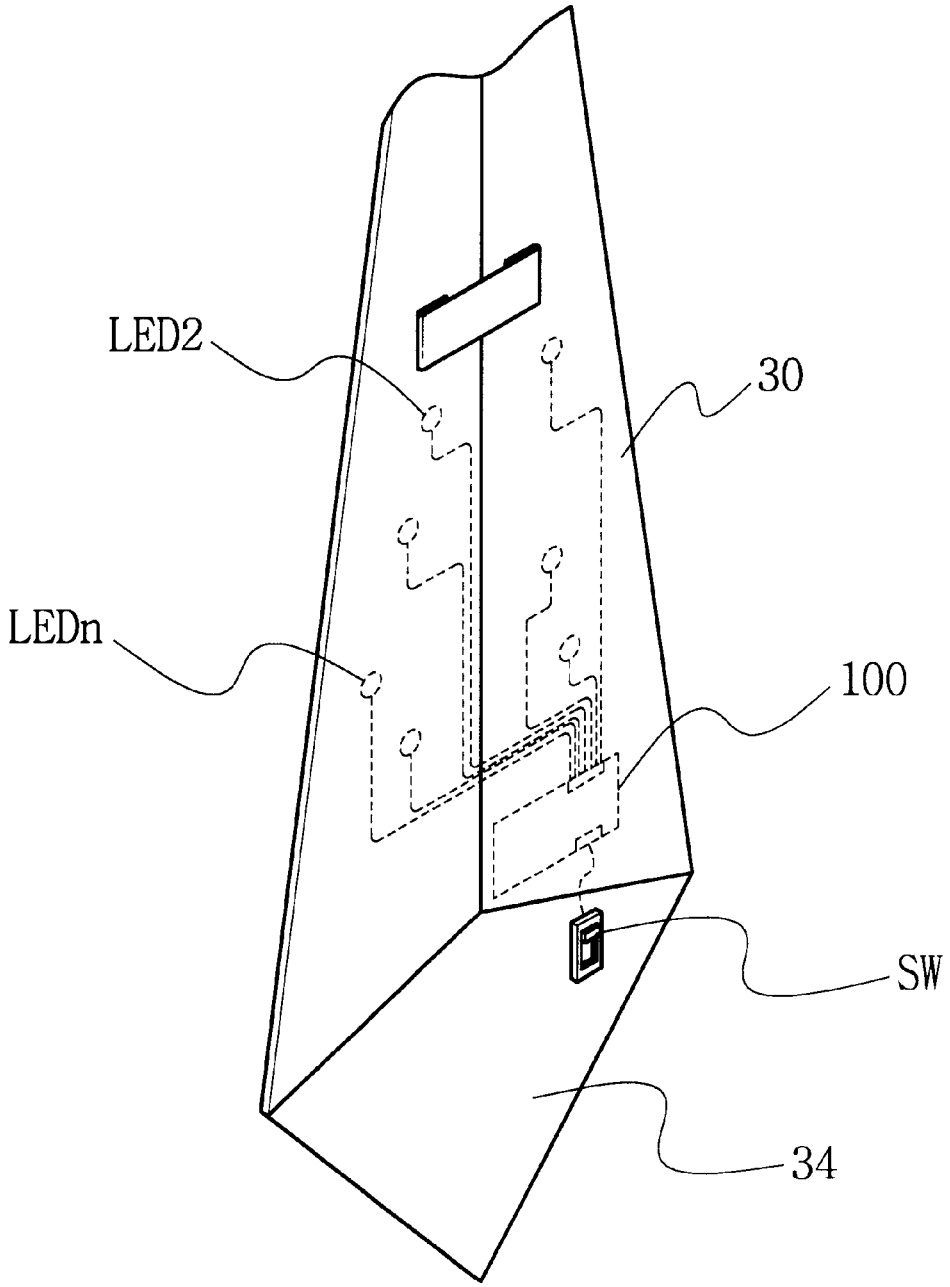
FIG. 3 is a rear squint view showing the luminous necktie according to the present invention.

Referring now to the drawings, the embodiments according to this invention are described in detail.

As shown in FIG. 1 to FIG. 4, this invention comprises a large number of light-emitting-diodes (LED1, LED2, ~, LEDn) installed such that the light-emitting-diodes (LED1, LED2, , LEDn) are exposed to the front part of a necktie 30; an oscillation circuit portion 40 for flashing said light-emitting-diodes (LED1, LED2, ~, LEDn); and a switch (SW) giving trigger signals to the trigger signal input end (T) of said oscillation circuit 40. signal input end (T) of said oscillation circuit 40.

Said switch (SW) is set at the rear of the large width portion 34 of said necktie 30.

Figure 5:
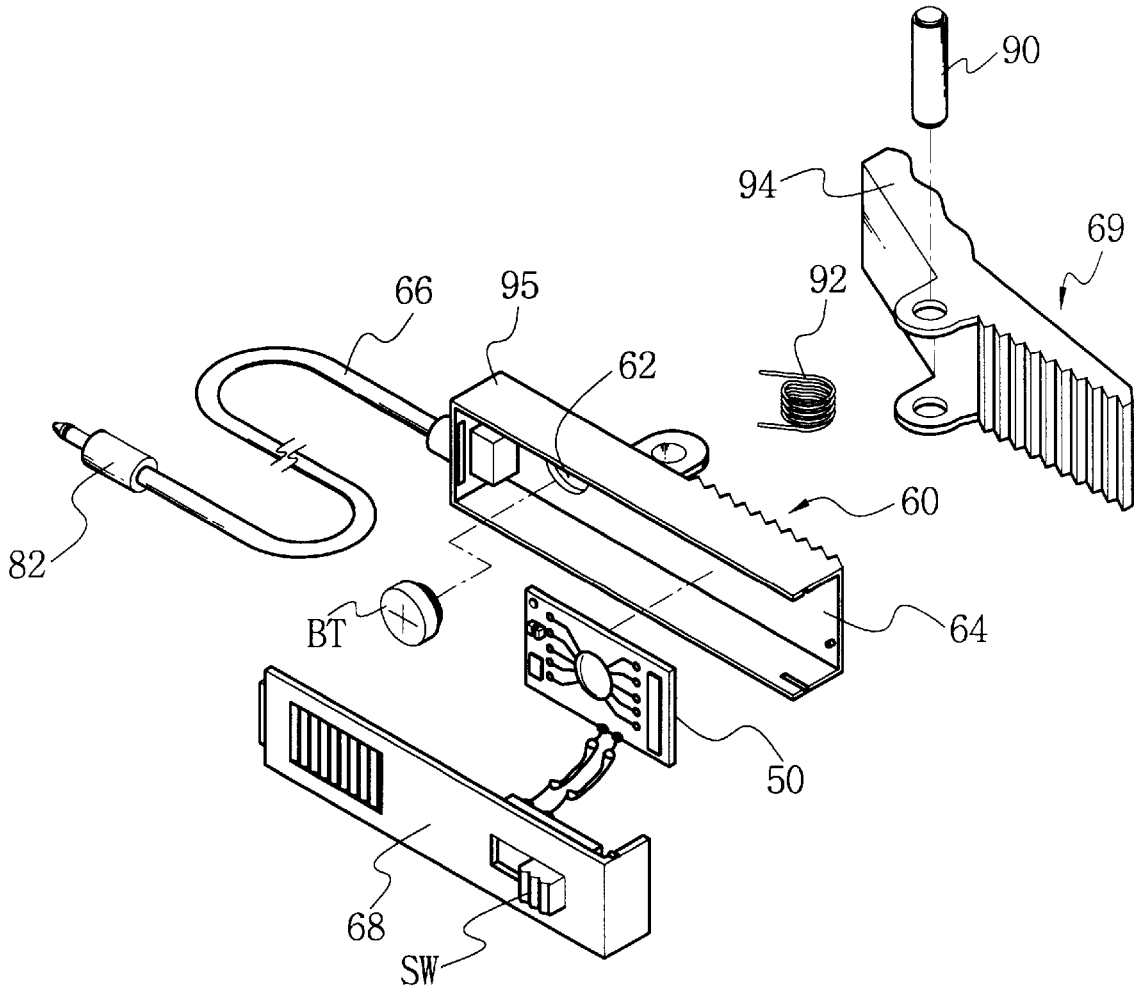
FIG. 5 is a separated squint view showing an embodiment of the luminous necktie, according to the present invention, constituted in a separable type by using a case and a connector.
Figure 6:
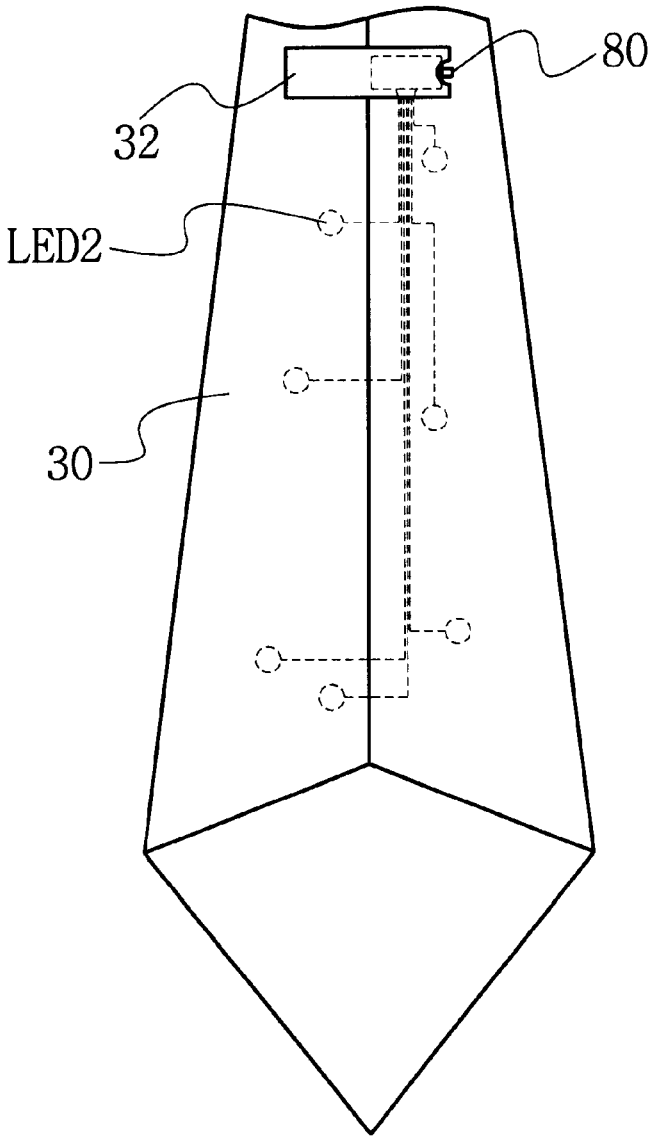
FIG. 6 is a rear view showing the installation place of the connector in case of the luminous necktie, according to the present invention, constituted in a separable type by using a case.
Figure 7:
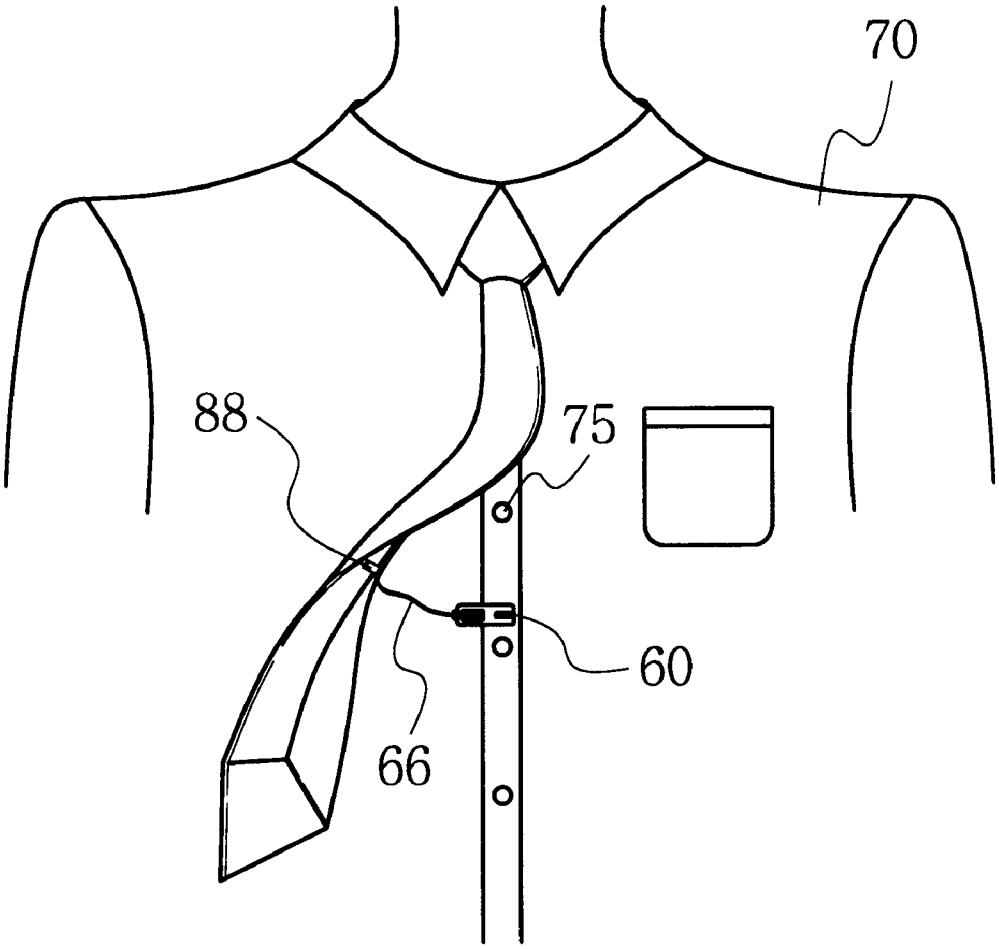
FIG. 7 is a front view showing the state that the connector of the luminous necktie according to the present invention and the cable drawn out from the case are joint to each other.

As shown in FIG. 5 to FIG. 7, this invention comprises a battery receiving chamber 62 receiving a battery (BT); a wafer receiving chamber 64 receiving a printed circuit wafer 50; a case 60 having a forceps 69 which is inserted in the front portion of the shirt 70; a cable 66 installed at one side of the case 60; a plug 82 installed at the end of said cable 66 in order to be joined to the connector 80 (forming joined connector/plug 88) which is connected to the light-emitting-diodes (LED1, LED2, ~, LEDn); and a cover 68 covering said battery receiving chamber 62 and said wafer receiving chamber 64.

Said connector 80 can be installed at the rear of the necktie 30, especially at the inserting portion 32 in which the small width portion of the necktie is inserted.

Said forceps 69 and said case 60, as shown in FIG. 5, are bound by a hinge pin 90 and the forceps 69 is constituted to have always a biting force by a torsion spring 92.

Also, handles 94 and 95 are formed at one side of the forceps 69 and the case 60 respectively in order to be convenient for use when taking by fingers of a user. And they can be inserted in the space of the portion in which the buttons 75 of the shirt 70 are positioned.

Figure 4:
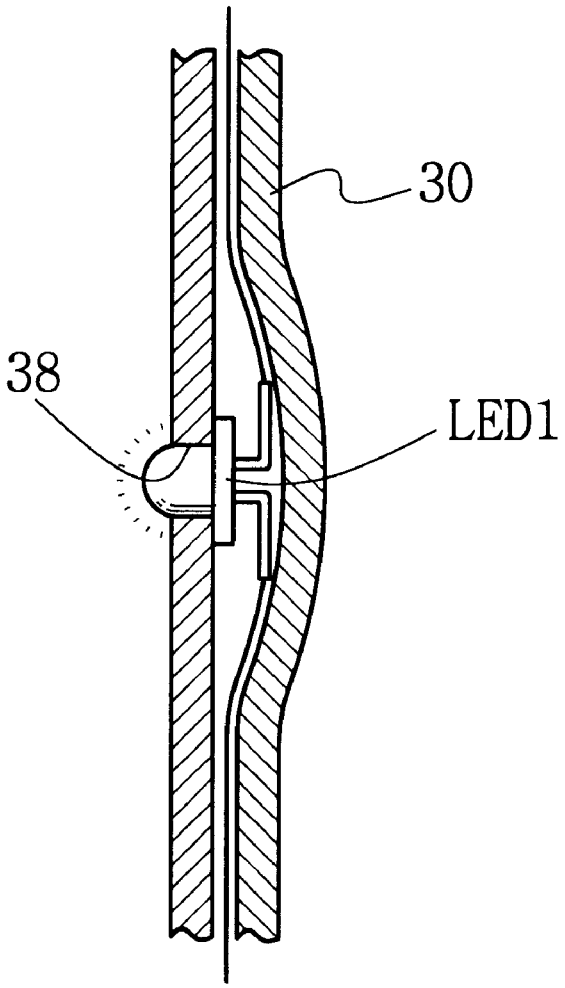
FIG. 4 is a sectional view showing the state of light-emitting-diodes installed in the luminous necktie according to the present invention.

The leading pins of said light-emitting-diodes(LED1, LED2, ~, LEDn) are bent in the opposite direction, placed inside the cloth of the necktie 30 as shown in FIG. 4 and fixed thereto by an adhesive and so forth. The light-emitting-diodes(LED1, LED2, ~, LEDn) are formed in the holes 38 of the necktie 30 so as to be exposed to the front part of the necktie 30.

On one hand, said light-emitting-diodes(LED1, LED2, ~, LEDn) can be made in several colors to emit various color lights.

In drawings, signs R11, R12, R1n, which are not explained, are current limit resistances for limiting the current flowing to said light-emitting-diodes (LED1, LED2, ~, LEDn) below rated current, R1 is a pull-up resistance for impressing high electric potential to the trigger signal input end (T) of the oscillation circuit portion 40 when the joint point of said switch (SW) is open; VR is a variable resistance for varying the oscillation cycle of said oscillation circuit portion 40; and 100 is a printed circuit wafer.

Hereinafter, the effect of the present invention will be described in more detail referring to the attached drawings.

First of all, as shown in FIG. 1 to FIG. 4, when the joint point is closed by managing the switch (SW) installed at the rear of the large width portion 34 of the necktie 30, a low electrical potential is impressed through the trigger signal input end (T) of the oscillation circuit portion 40, at the same time, a pulse wave is outputed from a large number of the output ends comprised at the oscillation circuit portion 40.

At this time, at the positive edge of the pulse wave outputted from the output end of the oscillation circuit portion 40, a driving current flows, passing through current limit resistances (R11, R12, ~, R1n) which are connected to the output end of the oscillation circuit portion 40, to each of light-emitting-diodes (LED1, LED2, ~, LEDn) are put out. As a result, the light-emitting-diodes (LED1, LED2, ~, LEDn) flash periodically.

That is, the light emitted from the light-emitting-diodes (LED1, LED2, ~, LEDn) are radiated outside from the holes formed in the necktie 30 so that people in the front of the necktie can see the diodes and emitted light.

During the above process, if the oscillation cycle of the pulse wave outputed from the oscillation circuit portion 40 is varied by using the variable resistance (VR), the flashing cycles of the light-emitting-diodes (LED1, LED2, ~, LEDn) are varied.

On the other hand, as shown in FIG. 5 to FIG. 7, in the case where the connector 80 and plug 82 are attachable to or removable from each other, when plug 82 is separated from connector 80, only the light-emitting-diodes (LED1, LED2, ~, LEDn) and the lead wires remain so that the necktie 30 can be washed with water.

And, in case of taking the handles 94 and 95 positioned at the forceps 69 and the case 60, the torsion spring 92 is twisted to open the space between the forceps 69 and the case 60, at this time, the handle 94 is inserted in the space positioned at the shirt button, and then, by removing the force which is pushing the handles 94 and 95 with fingers, the elastic restoring force of the torsion spring 92 fixes the forceps 69 and the case 60 to the shirt 70.

At this time, when the switch (SW) is closed after the joining of connector 80 and plug 82 (forming joined connector/plug 88), the pulse wave is outputted through the output end of oscillation circuit portion 40 to light-emitting-diodes (LED1, LED2, ~, LEDn), and then these light-emitting-diodes (LED1, LED2, ~, LEDn) flash.

Also, when a battery is needed to be exchanged, the battery exchange comprises the steps of opening the cover 68 bound to the case 60; removing the discharged battery (BT) in the battery receiving chamber 62; inserting again a new battery (BT); and closing the cover 68.

As described above, the present invention comprises flashing light-emitting-diodes in a necktie to attract people's attention as well as to raise the discrimination, especially in the night. Also, the light-emitting-diodes are in harmony with designs formed in the surface of the necktie to give a sense of beauty to who sees the necktie.

What is claimed is:

1. A luminous necktie comprising a necktie with a front portion, an inner portion, and a rear portion; a plurality of light-emitting-diodes exposed to the front portion of the necktie wherein each light-emitting-diode is fixed to the inner portion of the necktie;

an oscillation circuit portion for flashing said light-emitting-diodes;

a switch for giving trigger signals to a trigger signal input end of said oscillation circuit portion;

wherein said luminous necktie further comprises a case having a battery receiving chamber receiving a battery, a wafer receiving chamber receiving a printed circuit wafer and a forceps which is inserted in a front surface of a shirt;

a plug installed at a second end of said cable detachably joined to a connector connected to the light-emitting-diodes; and a cover covering said battery receiving chamber and said wafer receiving chamber wherein said oscillation circuit portion is located on said printed circuit wafer.

2. A luminous necktie as claimed in claim 1, characterized in that said connector is installed at an inserting portion formed at the rear portion of the necktie.

3. A luminous necktie as claimed in claim 1, wherein said plurality of light-emitting-diodes emit colored light.

4. A luminous necktie as claimed in claim 1, wherein said plurality of light-emitting-diodes emit are made in a plurality of colors to emit a plurality of colors of light.

5. A luminous necktie as claimed in claim 1, wherein said plurality of light-emitting-diodes flash light periodically.

6. A luminous necktie as claimed in claim 1, wherein said plurality of light-emitting-diodes flash light in varying cycles.

7. A luminous necktie as claimed in claim 1, wherein said switch is electrically connected to said printed circuit wafer.

8. A luminous necktie as claimed in claim 1, wherein said cover further comprises a slot through which said switch is exposed wherein the switch is electrically connected to said printed circuit wafer.

9. A luminous necktie as claimed in claim 1 characterized in that said switch is installed on said case.

10. A power and circuitry case characterized in that it comprises a case having a battery receiving chamber receiving a battery and a wafer receiving chamber receiving a printed circuit wafer further comprising an oscillation circuit for causing light sources to flash;

a forceps attachable to a front surface of a shirt;

a cable installed at one end of said case;

a plug installed at a second end of said cable, wherein said plug is attachable to a connector for powering light sources;

a cover covering said battery receiving chamber and said wafer receiving chamber; and a switch for giving trigger signals to a trigger signal input end of said oscillation circuit portion.

11. A power and circuitry case as claimed in claim 10 wherein said connector for powering light sources is installed in an article of clothing.

* * * * *